US005794529A

United States Patent [19]

Dawley et al.

[11] Patent Number: 5,794,529

[45] Date of Patent: Aug. 18, 1998

[54] COMPLIANT DRIVE FOR PRINTING PRESSES

[75] Inventors: Douglas Joseph Dawley, Epping; Michael Lee Hearn; David William Dupuis, both of Dover, all of N.H.

[73] Assignees: Heidelberger Druckmaschinen AG, Heidelberg, Germany; Heidelberg Harris, Inc., Dover, N.H.

[21] Appl. No.: 641,857

[22] Filed: May 2, 1996

[51] Int. Cl.[6] ..... B41F 5/00

[52] U.S. Cl. ..... 101/216; 101/248; 74/409

[58] Field of Search ..... 101/177, 181, 101/183, 212, 216, 219, 220, 248; 74/409, 440; 475/346, 347

[56] References Cited

U.S. PATENT DOCUMENTS

| | | | |
|---|---|---|---|
| 2,810,299 | 2/1957 | Partridge . | |
| 2,887,046 | 5/1959 | Knops et al. . | |
| 3,407,727 | 10/1968 | Fischer | 101/177 |
| 3,606,800 | 9/1971 | Treff et al. . | |
| 3,703,863 | 11/1972 | Giuiuzza . | |
| 3,742,849 | 7/1973 | Greiner et al. . | |
| 3,834,181 | 9/1974 | Strasburg et al. | 64/1 |
| 4,724,763 | 2/1988 | Bolza-Schünemann et al. | 101/426 |
| 4,753,168 | 6/1988 | Theilacker et al. . | |
| 5,357,858 | 10/1994 | Guaraldi et al. . | |

FOREIGN PATENT DOCUMENTS

| | | |
|---|---|---|
| 1275628 | 5/1972 | United Kingdom . |
| 2071274 | 9/1981 | United Kingdom . |
| 2138538 | 10/1984 | United Kingdom . |
| 1199175 | 7/1990 | United Kingdom . |

*Primary Examiner*—Ren Yan
*Attorney, Agent, or Firm*—Kenyon & Kenyon

[57] ABSTRACT

A complaint drive for use in a printing press. The compliant drive is coupled to a driving gear which can be on the plate cylinder of the printing press. The compliant drive includes an input gear meshing with the driving gear. A compliant coupling is connected between the input gear and a first output gear. The compliant coupling includes circumferentially-spaced compression springs between the input gear and the first output gear. The first output gear can drive a driven gear which in turn drives a vibrator in a dampener. The first output gear can also drive a second output gear. Each of the input gear, first output gear and second output gear are mounted on rolling contact bearings, which improves efficiency of the drive and, with the compliant coupling, prevents transmission of transient forces, shocks or vibrations to the plate cylinder, thereby eliminating doubling of the printed images.

19 Claims, 2 Drawing Sheets

COMPLIANT DRIVE FOR PRINTING PRESSES

BACKGROUND OF THE INVENTION

1. Field of the Invention

The present invention relates to an apparatus for preventing the transmission of high-frequency forces, vibrations or shocks across a drive, which apparatus operates in a highly efficient manner. More specifically, the present invention relates to a compliant driving apparatus used in a printing press for preventing transmission of high-frequency torque variations from an inker/dampener to the plate cylinder. The present invention prevents transmission of these torque variations to the plate cylinder, thereby reducing doubling. The efficiency of the present invention is maximized by minimizing the friction or stiction, or fretting wear between the movable parts.

2. Description of the Prior Art

U.S. Pat. No. 5,357,858 shows a device for preventing circumferential separation between a blanket cylinder gear and a plate cylinder gear. Part of the device includes gears 94, 108 mounted for relative rotation through a sleeve or journal bearing 96, 110.

SUMMARY OF THE INVENTION

A drive mechanism constructed in accordance with the present invention allows transmission of torque through the drive, so that a driving element can drive a driven element. The drive mechanism of the present invention, however, prevents transmission of force, vibrations or shock in the opposite direction, through the use of a compliant mechanism between driven and driving gear elements in the drive. The drive mechanism is designed to prevent stiction or fretting wear from reducing the efficiency of the drive, thereby eliminating efficiency loss through hysteresis.

In a preferred embodiment of the present invention, a plate cylinder gear is connected to the input of the compliant drive of the present invention. An output of the compliant drive is, in the preferred embodiment, connected to a vibrator mechanism, specifically an ink vibrator and a water vibrator. The compliant drive includes an input gear, driven by the plate cylinder gear. The input gear is connected, through a compliant connection allowing compliant transmission of torque, to at least one output gear. In a preferred embodiment, there can be a first output gear coupled through a compliant connection to the input gear, and a second output gear, coupled through a clutch to the first output gear. In the preferred embodiment, the first output gear is coupled to, and drives, a gear for the water vibrator, and the second output gear is coupled to, and drives, a gear for the ink vibrator.

The compliant connection can preferably be formed by a series of circumferentially-mounted spring couplings, including a compression spring and a transmission pin. The transmission pin is preferably fixed in the input gear, and is circumferentially movable within the output gear against the bias of the compression spring.

Both the input and the output gears are mounted on rolling contact bearings to essentially eliminate any friction or stiction between the gears a and the shaft about which they turn. The rolling contact bearings also prevent the occurrence of fretting wear between the gears and the shaft. The rolling contact bearings therefore essentially eliminate inefficiencies in the operation of the drive which can result in the transmission of force, vibration or shock from the drive outputs back through the drive input, in contravention of the compliant coupling.

BRIEF DESCRIPTION OF THE DRAWINGS

The foregoing and other features of the present invention will become apparent to those skilled in the art to which t he present invention r elates from reading the following description with reference to the accompanying drawings, in which.

DETAILED DESCRIPTION OF THE INVENTION

Figure 2:
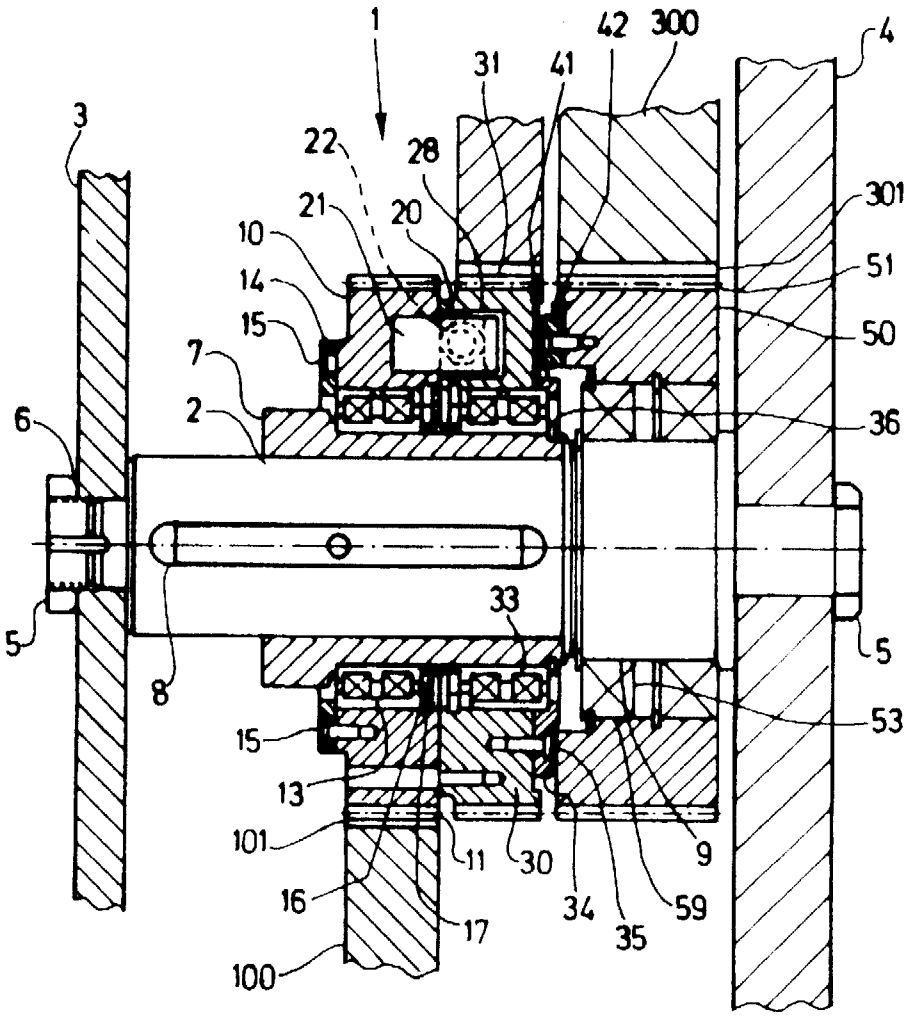
FIG. 2 is cross-sectional view of the embodiment of FIG. 1 along line II—II of FIG. 1.
Figure 1:
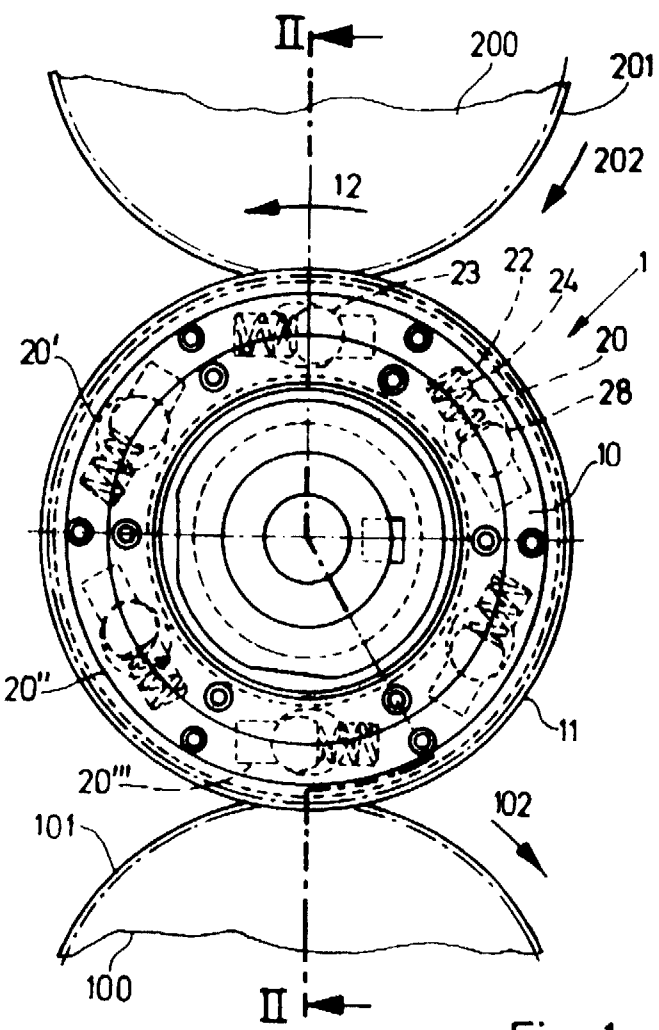
FIG. 1 is an end view of an embodiment of the compliant drive of the present invention.

As shown in FIGS. 1 and 2, a driving gear 100 with teeth 101 is mounted for rotation in a driving direction 102. Teeth 101 of driving gear 100 mesh with teeth 11 of an input gear 10 of a compliant drive apparatus 1. In a preferred embodiment of the present invention, driving gear 100 is mounted to a plate cylinder in an offset printing press apparatus. Input gear 10 is mounted for rotation about a shaft 2. Shaft 2 is fixed to supports 3, 4 of a printing press apparatus by suitable fastening devices such as, inter alia, nuts 5 and washers 6. A slide cylinder 7, connected to shaft 2 via a keyway/screw connection 8 to thereby prevent relative rotation between the parts, is used to removably mount input gear 10 on shaft 2. Between slide cylinder 7 and input gear 10 is mounted one or more rolling contact bearings 13, such as, inter alia, roller bearings or ball bearings, to allow essentially friction-free rotation of input gear 10 about slide cylinder 7 and shaft 2 in a direction of rotation 12. Input gear 10 can be mounted to rolling contact bearings 13 using a bearing cap 14 and screws 15. A bearing spacer 1 and a retaining ring 17 can be used for mounting of bearings 13.

Also mounted on slide cylinder 7 is a first output gear 30 with teeth 31. Teeth 31 of first output gear 30 mesh with teeth 201 of a first driven gear 200, thereby driving first driven gear 200 in a direction 202. In a preferred embodiment, first driven gear 200 drives a water vibrator in a press dampener. Between slide cylinder 7 and first output gear 30 is mounted one or more rolling contact bearings 33, such as, inter alia, roller bearings or ball bearings, to allow essentially friction-free rotation of first output gear 30 about slide cylinder 7 and shaft 2 in direction of rotation 12. First output gear 30 can be mounted to rolling contact bearings 33 using a bearing cap 34 and screws 35 similar to those used with rolling contact bearings 13. A bearing spacer and a retaining ring 36 can also be used for mounting of bearings 33.

Input gear 10 is coupled to first output gear 30 through a complaint coupling 20. Compliant coupling 20 is formed by a series of circumferentially-spaced coupling units 20', 20", 20'", etc., evenly circumferentially spaced around the input gear 10 and the first output gear 30. Each coupling unit 20', 20", 20'", etc., includes a cylindrical transmission pin 21 and a compression spring 22. Cylindrical transmission pin 21 extends between input gear 10 and first output gear 30. The end of cylindrical transmission pin 21 in input gear 10 is fixed to input gear 10, while the end of cylindrical transmission pin 21 in first output gear 30 is circumferentially movable with respect to first output gear 30, within an opening 28. The end of cylindrical transmission pin 21 within opening 28 contacts compression spring 22, which is contained within a borehole 24 in first output gear 30. The surface of cylindrical transmission pin 21 facing compression spring 22 may be flattened or recessed to more readily accommodate interaction with compression spring 22. The side of transmission pin 21 opposite compression spring 22 can contact a engagement face 23 of opening 28 when compliant drive apparatus 1 is not under the influence of input torque. Contact between transmission pin 21 and engagement face 23 ensures that the compliant drive apparatus 1 always returns to the same position, so that the teeth 11, 31 are properly aligned.

First output gear 30, in a preferred embodiment, is coupled to a second output gear 50 by a clutch mechanism 41, 42. Second output gear 50 includes teeth 51. Teeth 51 of second output gear 50 mesh with teeth 301 of a second driven gear 300, thereby driving second driven gear 300 in direction 202. In a preferred embodiment, second driven gear 300 drives an ink vibrator in a press dampener. Clutch mechanism 41, 42 allows first output gear 30 to drive second output gear 50 in direction of rotation 12. Second output gear 50 is rotatably mounted on shaft 2 by rolling contact bearings 53, such as, inter alia, roller bearings or ball bearings, which rolling contact bearings are fitted between an outer surface 9 of shaft 2 and an inner surface 59 of second output gear 50.

In operation of the device of the present invention, plate cylinder (not shown) is driven, thereby rotating driving gear 100 in direction 102. As the result of meshing between teeth 101 and teeth 11, rotation of driving gear 100 in direction 102 causes rotation of input gear 10 in direction 12. Rotation of input gear 10 in direction 12 causes torque to be transmitted between input gear 10 and first output gear 30, via the coupling units 20', 20", 20'", etc. As a result, first output gear 30 is rotated in direction 12. Rotation of input gear 10 and first output gear 30 is essentially friction- and stiction-free due to the use of rolling contact bearings 13, 33. First output gear 30, through meshing of teeth 31 and 201, rotates first driven gear 200 in direction 202. Rotation of first driven gear 200 in direction 202 drives, in the preferred embodiment, a water vibrator for the press dampener (not shown).

Rotation of first output gear 30 in direction 12 also drives second output gear 50 in direction 202, as the result of the coupling between first output gear 30 and second output gear 50 due to clutch 41, 42. Rotation of second output gear 50 is essentially friction- and stiction-free due to the use of rolling contact bearings 53. Second output gear 50, through meshing of teeth 51 and 301, rotates second driven gear 300 in direction 202. Rotation of second driven gear 300 in direction 202 drives, in the preferred embodiment, an ink vibrator for the press dampener (not shown).

Input gear 10 and first output gear 30, along with the associated rolling contact bearings 13, 33, can be easily removed from shaft 2 by sliding slide cylinder 7 off shaft 2.

Any force, shock or vibration in first output gear 200 or second output gear 300 in any direction 202 is prevented from being transmitted to driving gear, and thus to plate cylinder (not shown), through the coupling units 20. Such force, shock or vibration will simply cause compression springs 22 to compress or extend about a position of compression springs 22 caused by the nominal driving torque, preventing transient forces from transferring from first output gear 30 to input gear 10. Normal torque forces, i.e., the nominal driving torque, are still transmitted through the compliant drive, but transient torque errors are "filtered" by the compliant drive of the present invention. As a result, no force, shock or vibration is transmitted back to the plate cylinder through driving gear 100, and doubling of the printed image because of vibrations in the plate cylinder is eliminated. Additionally, torque is transmitted, and force, shock and vibrations prevented from being transmitted, with high efficiency because of the use of essentially friction-free rolling contact bearings 13, 33, 53 within the compliant drive 1.

Figure 3:
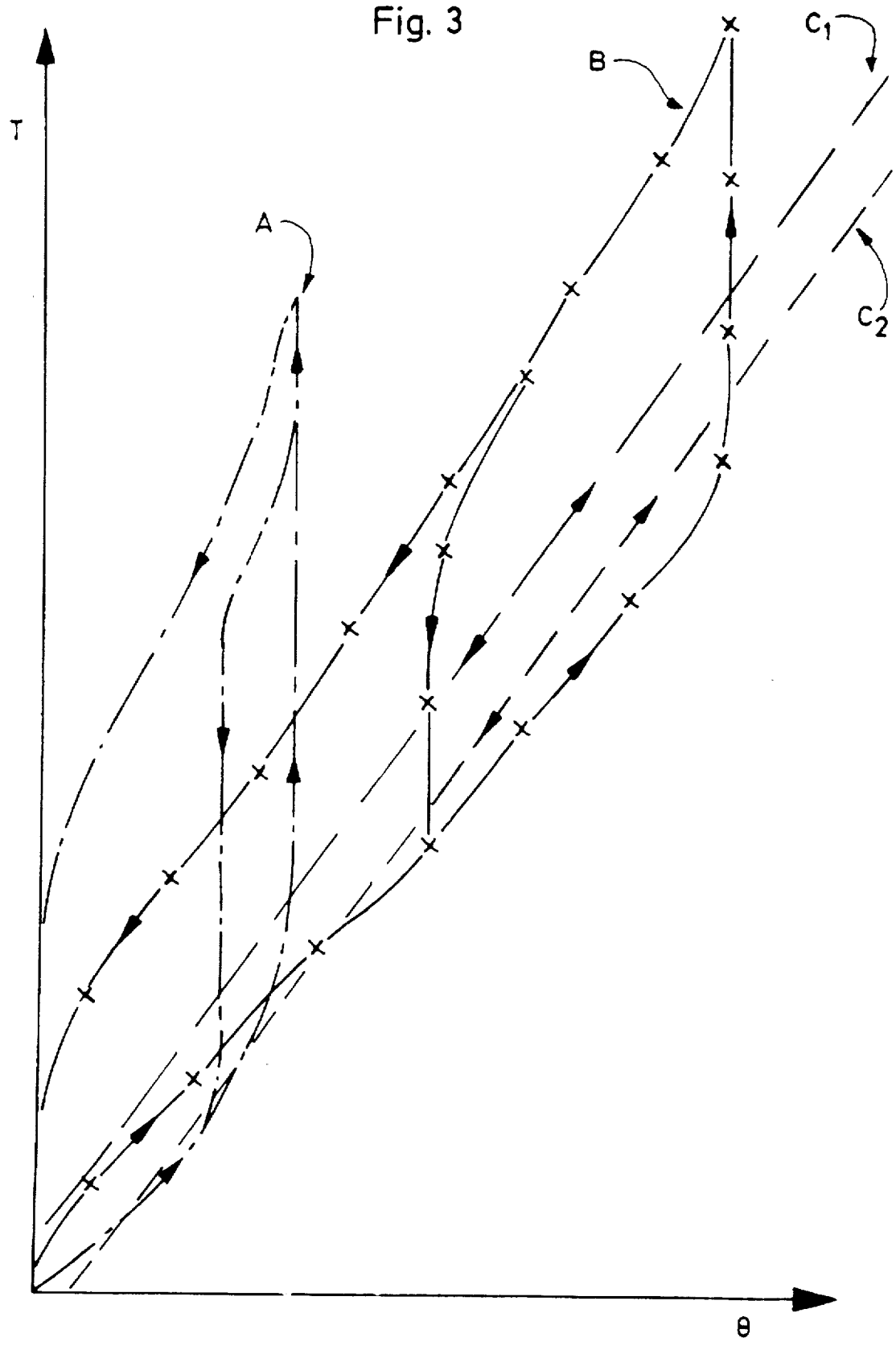
FIG. 3 is a graph showing the performance characteristics of the present invention in comparison to other compliant drive devices.

FIG. 3 illustrates the improved results achieved by the complaint drive of the present invention. FIG. 3 is a graph showing torque versus rotation for a compliant drive of the present invention and for other compliant drives. Curves $C_1$ and $C_2$ represent compliant drives constructed in accordance with the present invention. As can be seen in FIG. 3, the loading and unloading curves follow along an essentially straight line, indicating no efficiency losses with the use of a compliant drive of the present invention. Curves A and B represent compliant drives in which no rolling contact bearings are used to mount the rotating gears in the compliant drive. In the drives represented by curves A and B, a sleeve or journal bearing is used to mount the rotating gears in the compliant drive. As can be seen in FIG. 3, the curves A and B do not follow along a straight line during loading and unloading, and a loss of efficiency due to hysteresis is shown by the area between the loading and unloading curves for curves A and B.

From the above description of the invention, those skilled in the art will perceive improvements, changes and modifications. Such improvements, changes and modifications within the skill of the art are intended to be covered by the appended claims.

We claim:

1. A compliant drive comprising:

a driving gear;

at least one driven gear;

an input gear, the input gear being meshed only with the driving gear and driven by the driving gear;

at least one input gear rolling contact bearing, the input gear being mounted for rotation on the at least one input gear rolling contact bearing;

at least one output gear, the at least one output gear being meshed only with the at least one driven gear and driving the at least one driven gear;

at least one first output gear rolling contact bearing, the at least one output gear being mounted for rotation on the at least one first output gear rolling contact bearing; and at least one compliant coupling between the input gear and the at least one output gear, the compliant coupling comprising at least one biasing element.

2. The compliant drive of claim 1, wherein:

the at least one biasing element comprises a compression spring.

3. The compliant drive of claim 1, wherein:

the at least one compliant coupling comprises a pin extending between the input gear and the at least one output gear.

4. The compliant drive of claim 1, wherein:

the at least one compliant coupling comprises a plurality of biasing elements spaced circumferentially around the at least one output gear.

5. The compliant drive of claim 4, wherein:

the plurality of biasing elements comprise compression springs.

6. The compliant drive of claim 5, wherein:

the at least one compliant coupling comprises a plurality of pins extending between the input gear and the at least one output gear, the plurality of pins each being coupled to one of the plurality of compression springs.

7. The compliant drive of claim 6, wherein:

the plurality of pins are fixed to the input gear.

8. The compliant drive of claim 1, further comprising:

a cylinder, the input gear, at least one output gear, input gear rolling contact bearing and at least one first output gear rolling contact bearing being mounted on the cylinder.

9. A compliant drive for use in a printing press unit comprising:

a plate cylinder, the plate cylinder comprising a driving gear;

at least one driven gear;

an input gear, the input gear being meshed only with the driving gear and driven by the driving gear;

at least one input gear rolling contact bearing, the input gear being mounted for rotation on the at least one input gear rolling contact bearing;

at least one output gear, the at least one output gear being meshed only with the at least one driven gear and driving the at least one driven gear;

at least one first output gear rolling contact bearing, the at least one output gear being mounted for rotation on the at least one first output gear rolling contact bearing; and at least one compliant coupling between the input gear and the at least one output gear, the compliant coupling comprising at least one biasing element.

10. The compliant drive of claim 9, wherein:

the at least one biasing element comprises a compression spring.

11. The compliant drive of claim 9, wherein:

the at least one compliant coupling comprises a pin extending between the input gear and the at least one output gear.

12. The compliant drive of claim 9, wherein:

the at least one compliant coupling comprises a plurality of biasing elements spaced circumferentially around the at least one output gear.

13. The compliant drive of claim 12, wherein:

the plurality of biasing elements comprise compression springs.

14. The compliant drive of claim 13, wherein:

the at least one compliant coupling comprises a plurality of pins extending between the input gear and the at least one output gear, the plurality of pins each being coupled to one of the plurality of compression springs.

15. The compliant drive of claim 14, wherein:

the plurality of pins are fixed to the input gear.

16. The compliant drive of claim 9, further comprising:

a cylinder, the input gear, at least one output gear, input gear rolling contact bearing and at least one first output gear rolling contact bearing being mounted on the cylinder.

17. The compliant drive of claim 9, in combination with a water vibrator, the water vibrator being coupled to the at least one driven gear and being driven by the at least one driven gear.

18. A compliant drive between a driving element and at least one driven element comprising:

an input gear, the input gear being coupled to the driving element and driven by the driving element;

at least one input gear rolling contact bearing, the input gear being mounted for rotation on the at least one input gear rolling contact bearing;

at least one output gear, the at least one output gear being coupled to the at least one driven element and driving the at least one driven element;

at least one first output gear rolling contact bearing, the at least one output gear being mounted for rotation on the at least one first output gear rolling contact bearing;

at least one compliant coupling between the input gear and the at least one output gear, the compliant coupling comprising at least one biasing element;

a second output gear, the second output gear being coupled to the at least one output gear, the at least one output gear driving the second output gear; and at least one second output gear rolling contact bearing, the second output gear being mounted for rotation on the at least one second output gear rolling contact bearing.

19. A compliant drive for use in a printing press unit comprising:

a plate cylinder, the plate cylinder comprising a driving gear;

at least one driven gear;

an input gear, the input gear being coupled to the driving gear and driven by the driving gear;

at least one input gear rolling contact bearing, the input gear being mounted for rotation on the at least one input gear rolling contact bearing;

at least one output gear, the at least one output gear being coupled to the at least one driven gear and driving the at least one driven gear;

at least one first output gear rolling contact bearing, the at least one output gear being mounted for rotation on the at least one first output gear rolling contact bearing;

at least one compliant coupling between the input gear and the at least one output gear, the compliant coupling comprising at least one biasing element;

a second output gear, the second output gear being coupled to the at least one output gear, the at least one output gear driving the second output gear; and at least one second output gear rolling contact bearing, the second output gear being mounted for rotation on the at least one second output gear rolling contact bearing.

* * * * *